US006336892B1

(12) United States Patent
Squibb

(10) Patent No.: US 6,336,892 B1
(45) Date of Patent: Jan. 8, 2002

(54) STABILIZER APPARATUS FOR GYMNASTIC BAR ASSEMBLIES

(75) Inventor: Neal C. Squibb, Scranton, IA (US)

(73) Assignee: American Sports International, Ltd., Jefferson, IA (US)

( * ) Notice: Subject to any disclaimer, the term of this patent is extended or adjusted under 35 U.S.C. 154(b) by 0 days.

(21) Appl. No.: 09/712,332

(22) Filed: Nov. 14, 2000

(51) Int. Cl.[7] ..... A63B 7/02

(52) U.S. Cl. ..... 482/23; 482/24; 52/698; 52/149

(58) Field of Search ..... 52/698, 149, 166; 482/23, 24, 25, 27, 28, 29

(56) References Cited

U.S. PATENT DOCUMENTS 874,804 A * 12/1907 Stambaugh ..... 52/166
1,719,352 A * 7/1929 Young ..... 52/698
1,799,160 A * 4/1931 Frank ..... 52/698
2,262,761 A * 11/1941 Gay ..... 482/23
3,551,920 A * 1/1971 Greene ..... 52/698

* cited by examiner

*Primary Examiner*—Jerome W. Donnelly
(74) *Attorney, Agent, or Firm*—Zarley, McKee, Thomte, Voorhees & Sease, P.L.

(57) ABSTRACT

A stabilizer apparatus for gymnastic bar assemblies has an elongated floor plate with outer and inner ends. A vertical post having upper and lower ends is pivotally secured by its lower end to the outer end of the floor plate. A length adjustable bar having opposite ends extends between the upper end of the post and the inner end of the floor plate. The bar has opposite ends which are pivotally secured to the upper end of the post and the inner end of the plate. A pulley assembly is secured to the upper end of the post.

4 Claims, 5 Drawing Sheets

11
30
32
52
56
36
20
53
22
3-3
68
64
58
66
60
50
54
46
48
62
40
38
42
44
34
30
28
32
11

STABILIZER APPARATUS FOR GYMNASTIC BAR ASSEMBLIES

BACKGROUND OF THE INVENTION

Gymnastic devices, such as parallel bars, must be carefully braced by cables and the like to stabilize the entire gymnastic device during its use. This is conventionally accomplished by a series of cables which extend diagonally upwardly from a floor anchor for attachment to the vertical poles or supporting structure for the horizontal bars. With sufficient floor anchors and cables trussed in different configurations, sufficient stabilization of the bars is achieved.

However, conventional stabilization systems consume a large "footprint" on the floor space upon which the gymnastic apparatus is mounted. This sometimes limits the number of units that can be used within a given floor area, particularly in practice areas where floor space is more often at a premium.

It is therefore a principal object of this invention to provide a stabilizer apparatus for gymnastic bar assemblies which will consume a smaller floor area for stabilized gymnastic devices then afforded by existing equipment.

A further object of this invention is to provide a stabilizer apparatus for gymnastic bar assemblies that is easy to install and is safe to use.

These and other objects will be apparent to those skilled in the art.

SUMMARY OF THE INVENTION

A stabilizer apparatus for gymnastic bar assemblies has an elongated floor plate with outer and inner ends. A vertical post having upper and lower ends is pivotally secured by its lower end to the outer end of the floor plate.

A length adjustable bar having opposite ends extends between the upper end of the post and the inner end of the floor plate. The bar has opposite ends which are pivotally secured to the upper end of the post and the inner end of the plate. A pulley assembly is secured to the upper end of the post.

DESCRIPTION OF THE PREFERRED EMBODIMENT

Figure 1:
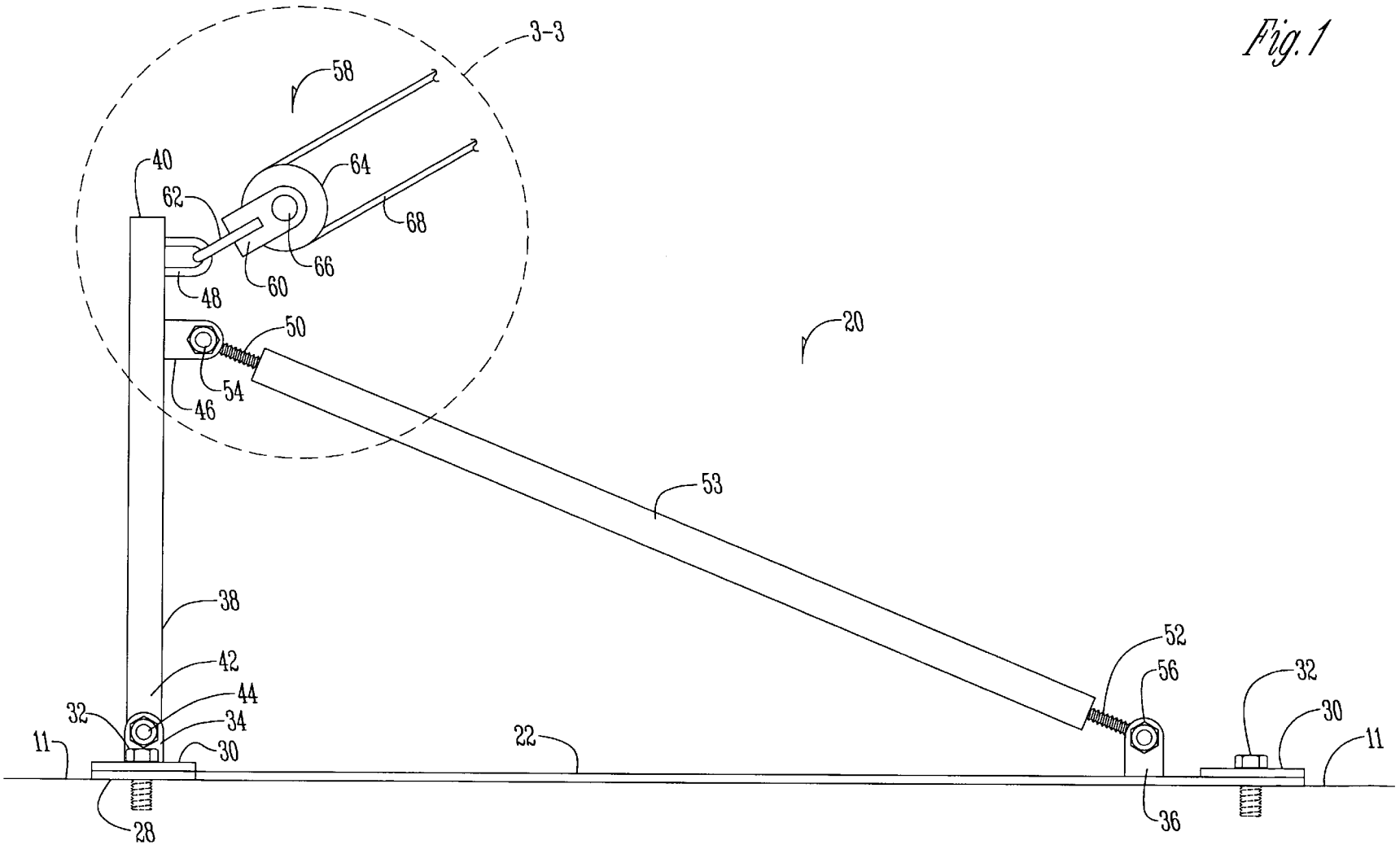
FIG. 1 is a side elevational view of the stabilizer apparatus of this invention.

A parallel bar assembly 10 (FIG. 5) is mounted on a conventional horizontal floor 11. Two parallel flat floor bars 12 are bolted or otherwise secured to the floor 11 by conventional means. Post 14 and 15 have lower ends pivotally secured to the bars 12 and extend upwardly. A horizontal gymnastic bar 16 extends between posts 14 and a second horizontal bar 18 extends between posts 15. The foregoing structure is conventional gymnastics equipment which has long been in existence.

Figure 2:
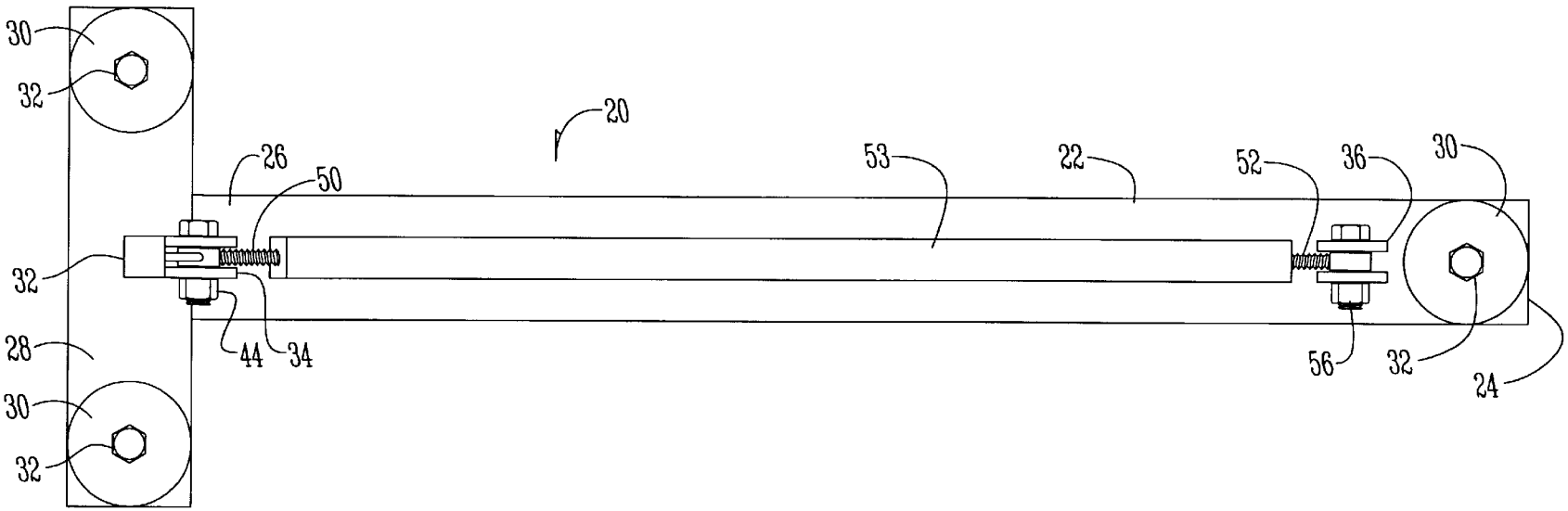
FIG. 2 is a top plan view of the device of FIG. 1.
Figure 5:
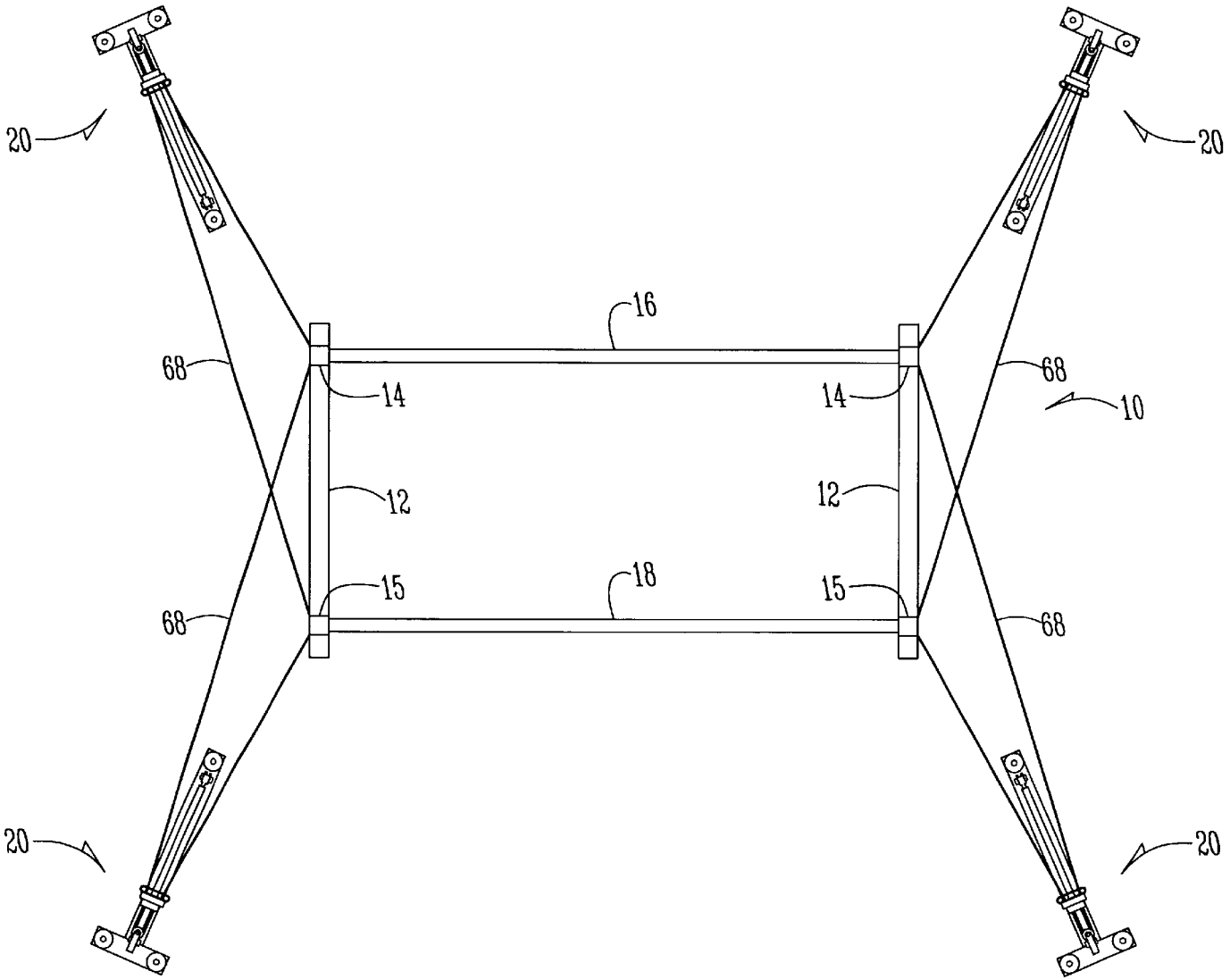
FIG. 5 is reduced scale plan view of the devices of FIGS. 1 through 4 interconnected with a gymnastic apparatus.

Four stabilizer units 20 are mounted to the floor 11 to enable the structure described heretofore to be stabilized. A plan view of this arrangement is shown in FIG. 5. Specifically, a stabilizer unit or apparatus 20 includes an elongated floor plate 22 having a inner end 24 and an outer end 26. (FIG. 2) A cross bar 28, (FIG. 2), is welded or otherwise secured to the outer end of the plate 22 and extends at right angles with respect to plate 22. Washers 30 and floor bolts 32 extend through the cross bar 28 and the inner end 24 of plate 22 to affix the stabilizer apparatus 20 to the floor 11.

An upstanding clevice 34 is secured to the outer end of plate 22 and a similar clevice 36 is rigidly secured to the inner end of plate 22 as best shown in FIG. 1.

An upstanding post 38 has an upper end 40 and a lower end 42 (FIG. 1). A horizontal pivot bolt 44 pivotally secures the post 38 within clevice 34 to create a pivotal relationship between the posts and the clevice. A similar clevice 46 is welded or otherwise secured to the upper end of post 38. A horizontal U-shaped link 48 is similarly rigidly secured to the upper end of post 38 above clevice 46 (FIG. 1).

Figure 3:
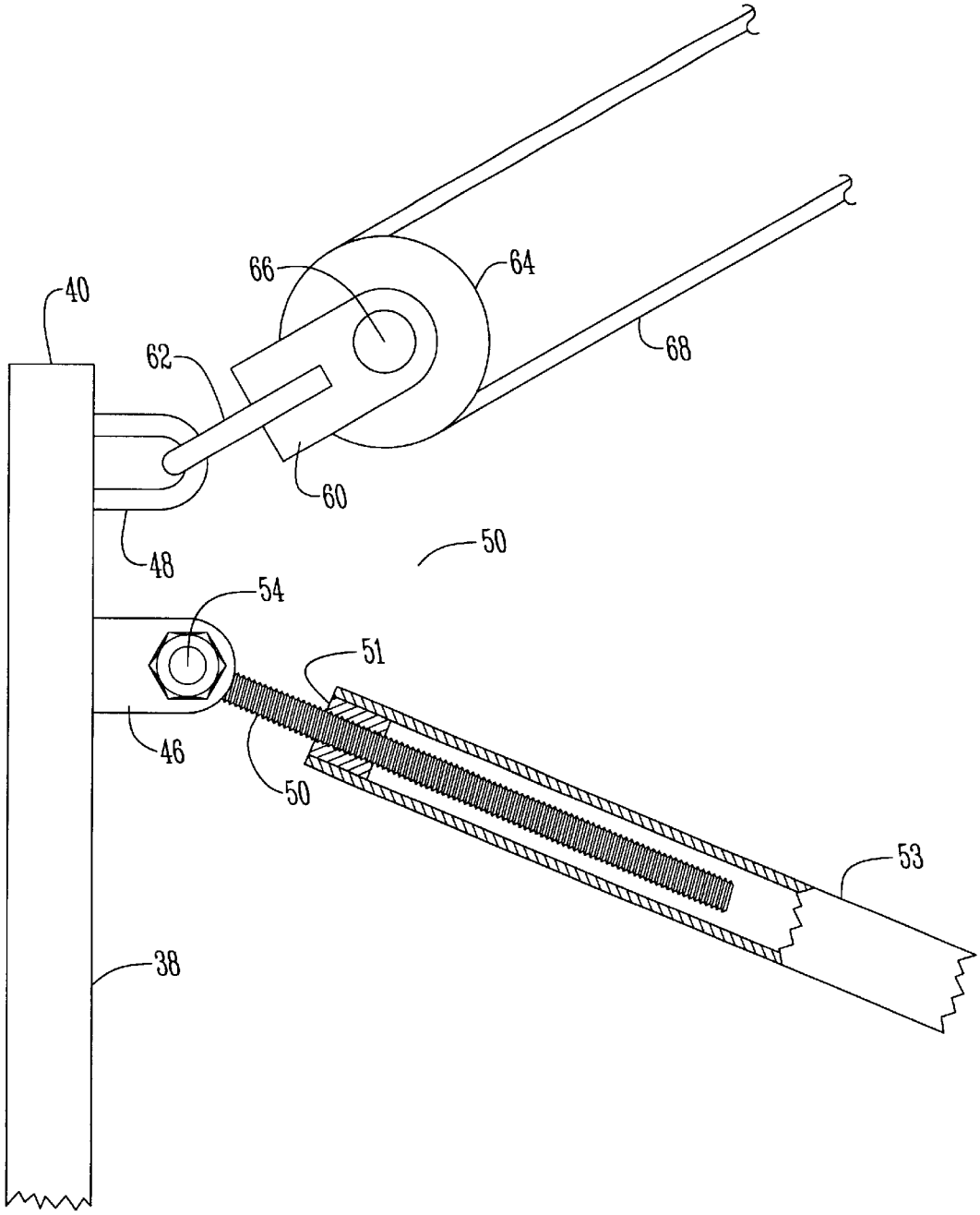
FIG. 3 is an enlarged elevational view of the subject matter of FIG. 1 surrounded by the line 3—3.
Figure 4:
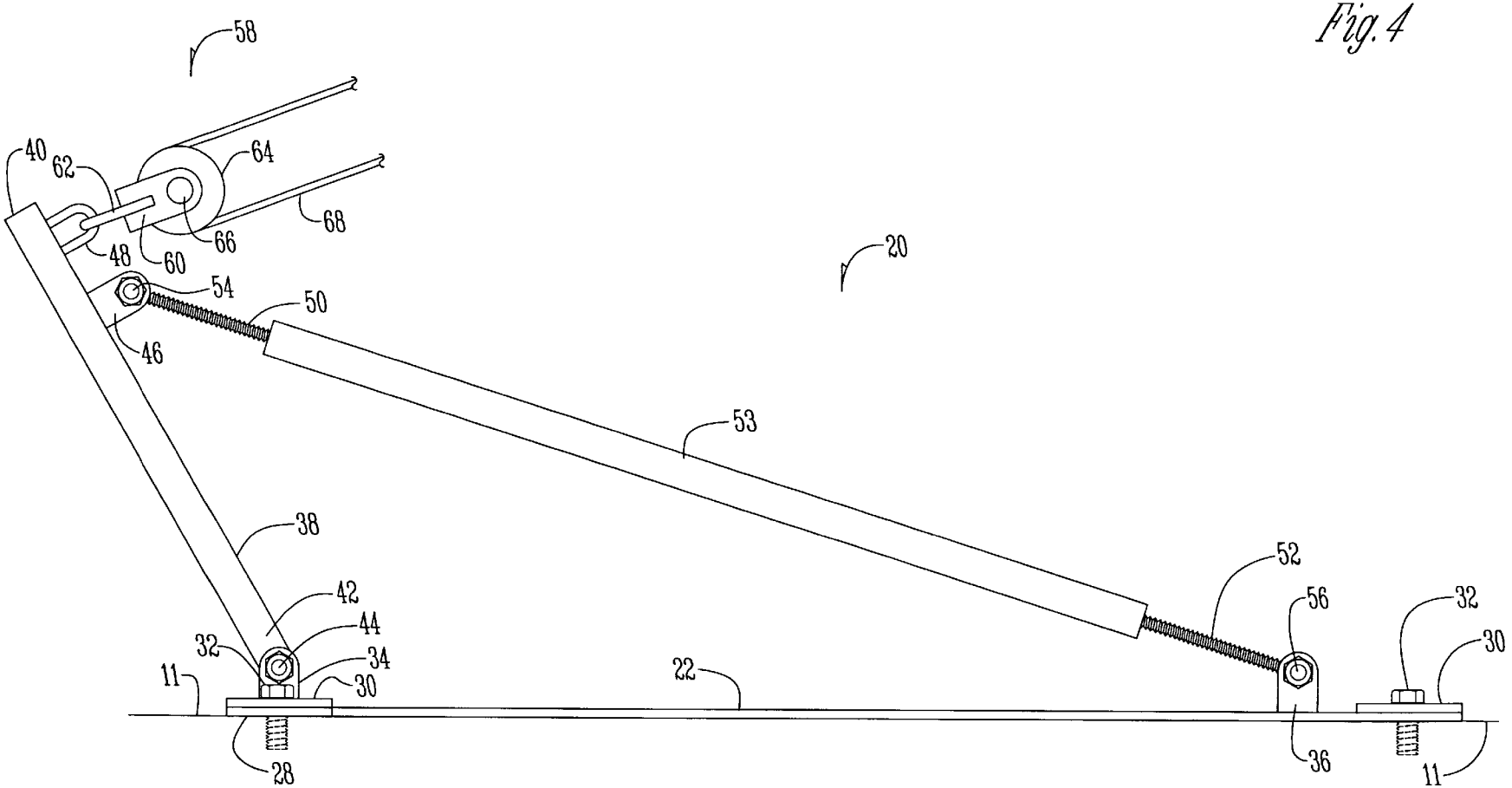
FIG. 4 is a view similar to that of FIG. 1 but shows the apparatus in a position to create tension on the supporting cables.

A hollow square bar 50 is supported between the devices 36 and 46 as shown in FIGS. 1 and 4. This is accomplished by upper eye bolt 50 and lower eye bolt 52 which are threadably secured within the ends of bar 50 by means of a threaded lug 51 which is rigidly secured within the opposite ends of bar 53 as best shown in FIG. 3. The threads on eye bolts 50 and 52 are oppositely configured, (lefthand threads and righthand threads) as are the opposite lugs 51 so that rotation of the bar 53 with respect to the eye bolts 50 and 52 will cause each of the eye bolts, respectively, to simultaneously extend outwardly from the ends of bar 53 or to move inwardly with respect to the ends of bar 53, depending upon the direction in which the bar 53 is rotated. Pivot bolts 54 and 56 extend through the eyelet portion of the eye bolts 50 and 52, respectively, to prevent the eye bolts from rotating and to effect the connection of bar 50 between clevices 36 and 46.

A pulley assembly 50 is movably connected to the link 48 at the top of each post 38. Each pulley assembly is comprised of a U-shaped bracket 60 (FIG. 3) to which is secured a U-shaped link 62 which is in turn movably connected to link 48 in the same manner that two links of a chain are interconnected. A conventional pulley 64 is mounted to bracket 60 by pin 66. A cable 68 of suitable length is threadably mounted around the periphery of pulley 64, with the ends of each cable 68 being interconnected to selected components of the parallel bar assembly. Typically, the ends of cable 68 would be connected to the upper portions of the upstanding posts 14 and 15.

In operation, four of the stabilizer units 20 are secured to the floor in close proximity to the parallel bar assembly as best shown in FIG. 5 by means of the anchor bolts 32 previously described. The cables 68 are threaded around pulleys 64 and are affixed to the post 14 and 15 of the parallel bar assembly. Then, each of the bars 53 are rotated to extend the length thereof as described above to effect tension on each of the cables 68 so as to provide balanced stabilizing forces on the parallel bar assembly.

It is seen that the device of this invention is easily installed and is easily connected to the parallel bar assembly. It is further evident that the stabilizing effect of the apparatus 20 by mere rotation of the bars 50 will accomplish the balanced stabilizing effect of the cables 68. Further the stabilizing units 20 permit the parallel bar assembly 10 to be erected and used in relatively smaller floor area than the area needed by conventional equipment. Thus, this invention is seen to achieve all of its stated objectives.

What is claimed is:

1. A stabilizer apparatus for gymnastic bar assemblies comprising, an elongated floor plate having outer and inner ends, a vertical post having upper and lower ends having its lower end pivotally secured to the outer end of the floor plate, a length adjustable bar having opposite ends extending between the upper end of the post and the inner end of the floor plate, the bar having opposite ends which are pivotally secured to the upper end of the post and the inner end of the plate, respectively, and a pulley assembly rigidly secured to the upper end of the post.

2. The device of claim 1 wherein the bar has pivotal connectors at its opposite ends for connection to the post and the plate, the pivotal connectors being threadably connected to the bar with opposite threads, so that rotation of the bar about a center elongated axis thereof will cause the post to pivot in a vertical plane passing through the post and the floor plate.

3. The device of claim 1 wherein the pulley assembly includes a rotatable pulley with a support bracket movably linked to the top of the post.

4. The device of claim 3 wherein the support bracket has a single link movably connected to a single link rigidly connected to the top of the post.

* * * * *